US008602926B2

(12) United States Patent
Griffith et al.

(10) Patent No.: US 8,602,926 B2
(45) **Date of Patent: *Dec. 10, 2013**

(54) COMPOSITE ARROW VANE

(75) Inventors: Larry R. Griffith, Lake City, MI (US); Anne-Marie Bebak, The Woodlands, TX (US)

(73) Assignee: The Bohning Company, Ltd, Lake City, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/448,559

(22) Filed: Apr. 17, 2012

(65) Prior Publication Data

US 2013/0274041 A1 Oct. 17, 2013

(51) Int. Cl.
*F42B 6/06* (2006.01)

(52) U.S. Cl.
USPC ..... 473/585

(58) Field of Classification Search
USPC ..... 473/578, 585, 586
See application file for complete search history.

(56) References Cited

U.S. PATENT DOCUMENTS 4,088,323 A * 5/1978 Munger ..... 473/586
7,037,865 B1 * 5/2006 Kimberly ..... 442/181
8,388,474 B1 * 3/2013 Griffith et al. ..... 473/586

* cited by examiner

*Primary Examiner* — John Ricci
(74) *Attorney, Agent, or Firm* — Smith Risley Tempel Santos LLC; Gregory Scott Smith

(57) ABSTRACT

Disclosed is a composite arrow vane for mounting to a projectile. The composite arrow vane is constructed of a composite material that includes a polymer matrix around structural elements. In some embodiments, the polymer matrix may be a thermoplastic polyurethane. The structural elements compounded into the polymer may be voids, hollow glass beads or just about any structure having a weight per unit volume that is less than the weight per unit volume of the polymer matrix. Advantageously, the composite material allows for reduced dimensions of the composite arrow vane because the increased tensile strength of the material allows for size reductions without significantly compromising vane performance. Similarly, the lighter weight per unit volume of the composite material as compared to a homogeneous polymer allows for increased flight speed of the projectile.

3 Claims, 6 Drawing Sheets

COMPOSITE ARROW VANE

BACKGROUND

The instant invention is generally directed to the field of archery and archery arrows and, more specifically, to the construction of vane structures used on archery arrows to control arrow flight.

An arrow with no vanes flies fast—however, it also flies erratically. To reduce erratic flight, archers necessarily sacrifice a certain amount of flight speed through the application of arrow vanes. Vanes, which may be constructed from natural feathers or synthetic materials, are typically mounted in a plurality arrangement, parallel to the aft end of an arrow shaft. Notably, loss of some flight speed due to drag and the added weight of the vanes is a necessary tradeoff to produce a certain amount of lift and side forces on the arrow. Advantageously, the lift and side forces introduced by vanes serve to stabilize an arrow's flight pattern by moving the center of pressure aftwards, thereby increasing shot accuracy.

Vanes also increase shot accuracy by introducing a spin motion to the flight of the arrow. For instance, spin is introduced by some vanes that have been fixed to the aft end of an arrow in an offset relative to the longitudinal axis of the arrow. In this way, as the arrow is projected forward on a path substantially in line with the arrow axis, the broad surface area of the vanes receive a force from the passing air that is translated to the arrow shaft on a vector offset from the arrow's longitudinal axis (i.e., a rolling moment), thereby causing the arrow to spin as it flies forward. Stiff material choices in vane construction mitigate deflection of the vanes in flight, thus optimizing the total rolling moment that can be produced.

Clearly, lighter vanes are desirable because they provide lift and side forces with a minimal addition of weight to slow flight speed. Also, stiffer vanes are desirable because they optimize the total rolling moment of an arrow. Therefore, what is needed in the art is an arrow vane constructed such that there is a decrease in overall vane weight without significantly sacrificing stiffness and without shrinking the physical profile of the vane. These needs, as well as other needs in the art, are addressed in the various embodiments of the invention as presented herein.

BRIEF SUMMARY

The various embodiments, features and aspects of the present invention overcome and/or alleviate some of the shortcomings in the above-noted prior art. Embodiments include a composite arrow vane for mounting to a projectile. The composite arrow vane may include a base for mounting on the surface of the projectile and a broad fin surface in communication with the base and configured to introduce lift and side forces when the projectile is launched.

The base and/or the fin of the composite arrow vane is constructed of a polymer matrix around structural elements ("composite material"). In some embodiments, the polymer matrix may be a thermoplastic polyurethane. Even so, it is envisioned that the polymer matrix may be constructed from any suitable material including, but not limited to, polyvinyl chloride ("PVC"), polypropylene, nylon, acrylonitrile butadiene styrene ("ABS"), etc. The structural elements surrounded by the polymer matrix may be hollow glass beads or bubbles. In other embodiments, the structural elements may take the form of just about any material having a weight per unit volume that is less than the weight per unit volume of the polymer matrix. Advantageously, the composite material allows for reduced dimensions of the composite arrow vane because the increased stiffness of the material allows for size reductions without significantly compromising vane performance. Similarly, the lighter weight per unit volume of the composite material as compared to a homogeneous polymer allows for increased flight speed of the projectile. But more importantly, it moves the center of gravity away from the center of Pressure.

Advantages of various embodiments of the composite arrow vane include (a) increased stiffness that allows for reduced vane dimensions, thus minimizing potential contact with an arrow rest or other bow component when an arrow is launched from a bow; (b) significant surface area useful for creating aerodynamic stability; (c) a center of pressure on par with heavier, larger profile vanes; (d) lighter weight than homogeneous vanes, thus allowing for faster projectile flight speeds.

The above-described and additional features may be considered, and will become apparent in conjunction with the drawings, in particular, and the detailed description which follow.

BRIEF DESCRIPTION OF THE SEVERAL VIEWS OF THE DRAWING

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

The present disclosure is directed towards providing a lightweight vane with a high integrity of structural rigidity, as well as features and aspects thereof, which can be attached to an arrow shaft to provide improved flight accuracy through increased lift and side forces and arrow shaft spin. Embodiments of the vane do not significantly increase the weight of an arrow relative to other vanes known in the art and, as such, provide flatter flight trajectories and faster flight speeds for a given vane profile.

An exemplary embodiment includes an arrow vane structure which, through its design characteristics and stiff, composite material selection, generally promotes arrow flight stability and shot accuracy while minimizing overall vane size and weight. In general, embodiments of the invention include a primary vane member that, as a result of its composite material of construction, is substantially rigid to maintain its shape and position during arrow flight. An exemplary composite material within the scope of this disclosure that may be leveraged in exemplary vane embodiments includes a thermoplastic polyurethane ("TPU") polymer compounded with a portion of hollow structural elements such as glass "bubbles." Advantageously, by using a composite material such as the exemplary TPU and glass bubble composite, a reduction in weight and increase in stiffness may be achieved in a given vane profile relative to the same profile constructed of a non-composite material. Similarly, by using a composite material such as the exemplary TPU and glass bubble composite, the thickness (and/or some other dimension) of a vane may be significantly reduced without sacrificing the overall stiffness of the vane.

Turning now to the figures in which like labels refer to like elements throughout the several views, various embodiments, aspects and features of the present invention are presented.

Figure 1:
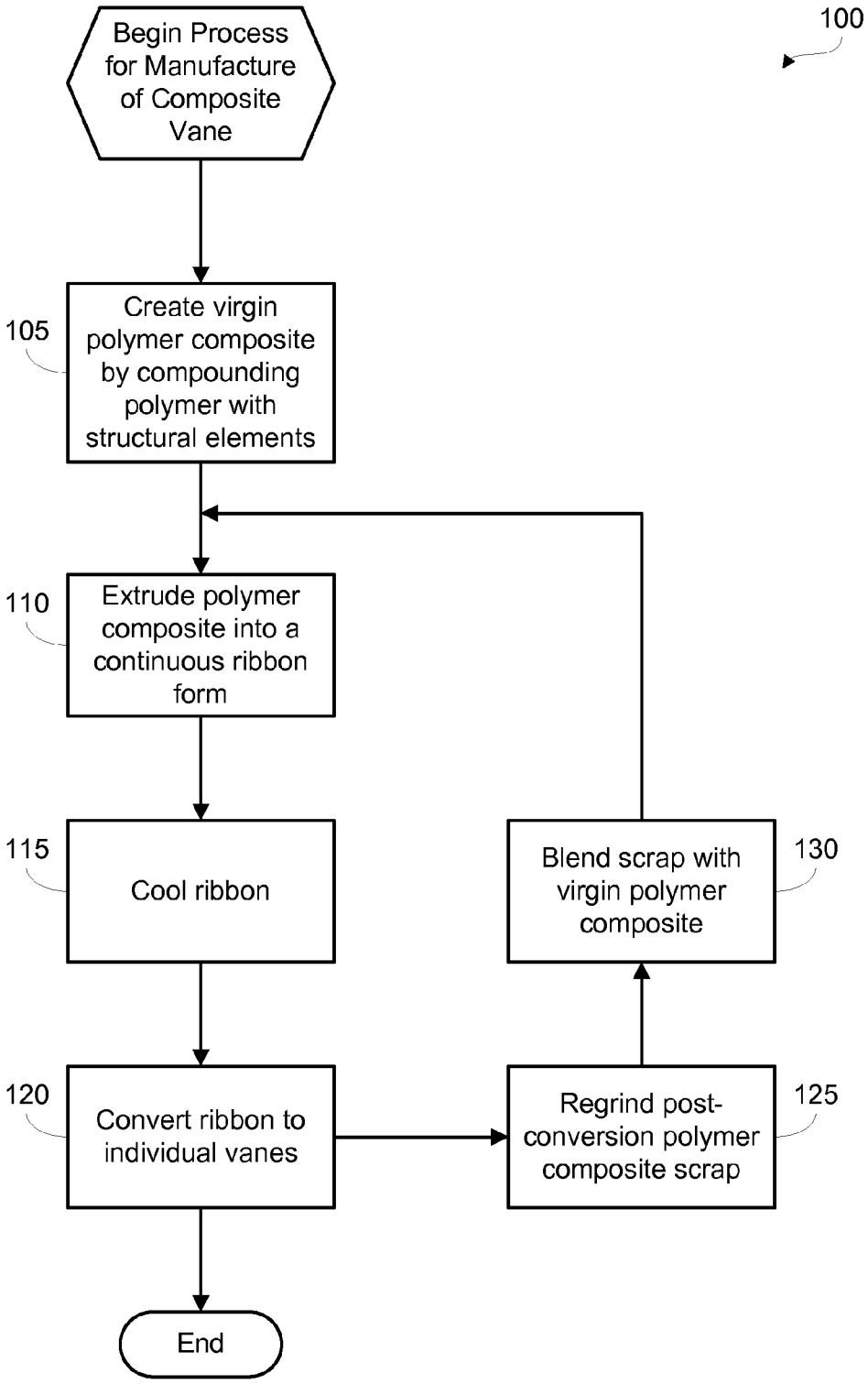
FIG. 1 is a logical flowchart illustrating an exemplary process for manufacture of composite arrow vanes.

FIG. 1 is a logical flowchart illustrating an exemplary process 100 for manufacture of composite arrow vanes. At block 105, a virgin polymer composite is created by compounding a polymer such as, but not limited to, a thermoplastic polyurethane polymer, an elastomeric rubber polymer, or the like with a portion of structural elements such as, but not limited to, microscopic glass bubbles. An exemplary compounding process may include melting the polymer prior to mixing in the structural elements. As is understood by one of ordinary skill in the art, the resultant virgin polymer composite may be in a pelletized form, although the particular form of the virgin polymer composite is envisioned to be any form suitable for input into the process 100.

At block 110, the virgin polymer composite may be input to an extruder, where it is pressurized and heated such that it can be extruded through a die, as is understood by one of ordinary skill in the art of rubber and/or plastic extrusion processes. Having been heated to, or near, a melt point, the virgin polymer composite is forced through a die to form a continuous ribbon having a cross-sectional profile consistent with the shape of the given die. Moreover, as one of ordinary skill in the art would understand, the cross-sectional profile of the continuous ribbon minors the cross-sectional profile of one or a plurality of arrow vanes, as the case may be.

At block 115, the continuous ribbon of virgin polymer composite is cooled such that the composite regains its memory properties, tensile strength, durability, and the like. As is understood by those of ordinary skill in the art of rubber and/or plastic extrusion, the ribbon may be cooled any number of ways including, but not limited to, exposure to a water bath. Once the ribbon is cooled, at block 120 the ribbon may be converted to arrow vanes by stamping or die cutting the vanes from the rubber, as would be understood by one of ordinary skill in the art. The scrap composite left over from the ribbon after having been converted to vanes at block 120 may be reground at block 125 and blended back into the virgin polymer composite at block 130 prior to extrusion at block 110.

Figure 2:
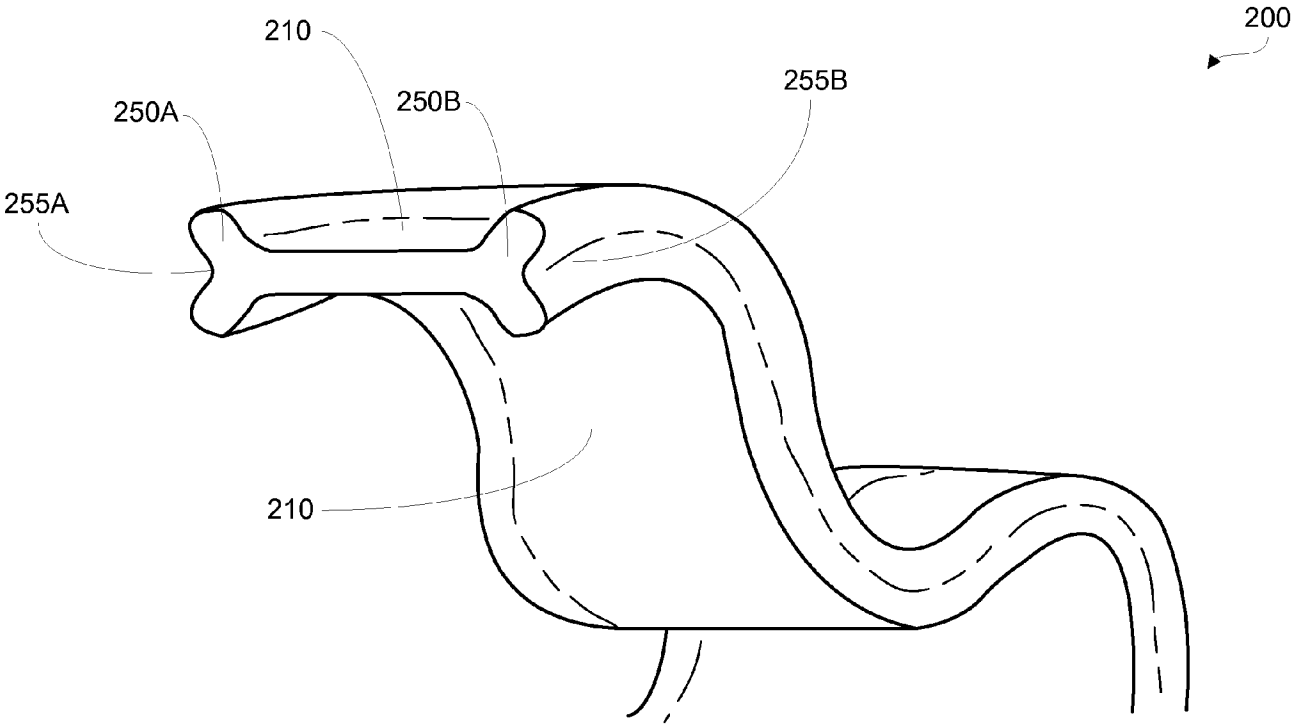
FIG. 2 is an illustration of a vane ribbon that may be produced during the FIG. 1 process prior to conversion into individual composite arrow vanes.

Turning to the FIG. 2 illustration, an exemplary vane ribbon 200 that may be the result of block 110 in the FIG. 1 process is depicted. As was explained above, the vane ribbon 200 may be converted to individual composite vanes by way of stamping, die cutting, laser cutting, water jet cutting, or the like. Notably, although the exemplary systems and methods described herein for the manufacture of composite arrow vanes include extrusion of a polymer composite into a ribbon that can be converted into composite arrow vanes, it will be understood that composite arrow vanes may be manufactured via other systems and methods known in the art. For instance, it is envisioned that composite arrow vanes may be manufactured via compression molding techniques, injection molding techniques, etc.

Returning to the FIG. 2 illustration, the exemplary vane ribbon 200 includes a cross-sectional shape 201 that approximates the cross-sections of two opposing composite arrow vanes. As such, the outer portions 250A, 250B of the cross-section 201 eventually form the bases of composite arrow vanes, respectively. Similarly, the outer edges 255A, 255B of the outer portions of the vane ribbon 200 eventually form the bottom surfaces of respective vanes. Also, the side surfaces 210, after the vane ribbon 200 is converted into individual composite arrow vanes, form the broad side surfaces of the given vanes.

Figure 3:
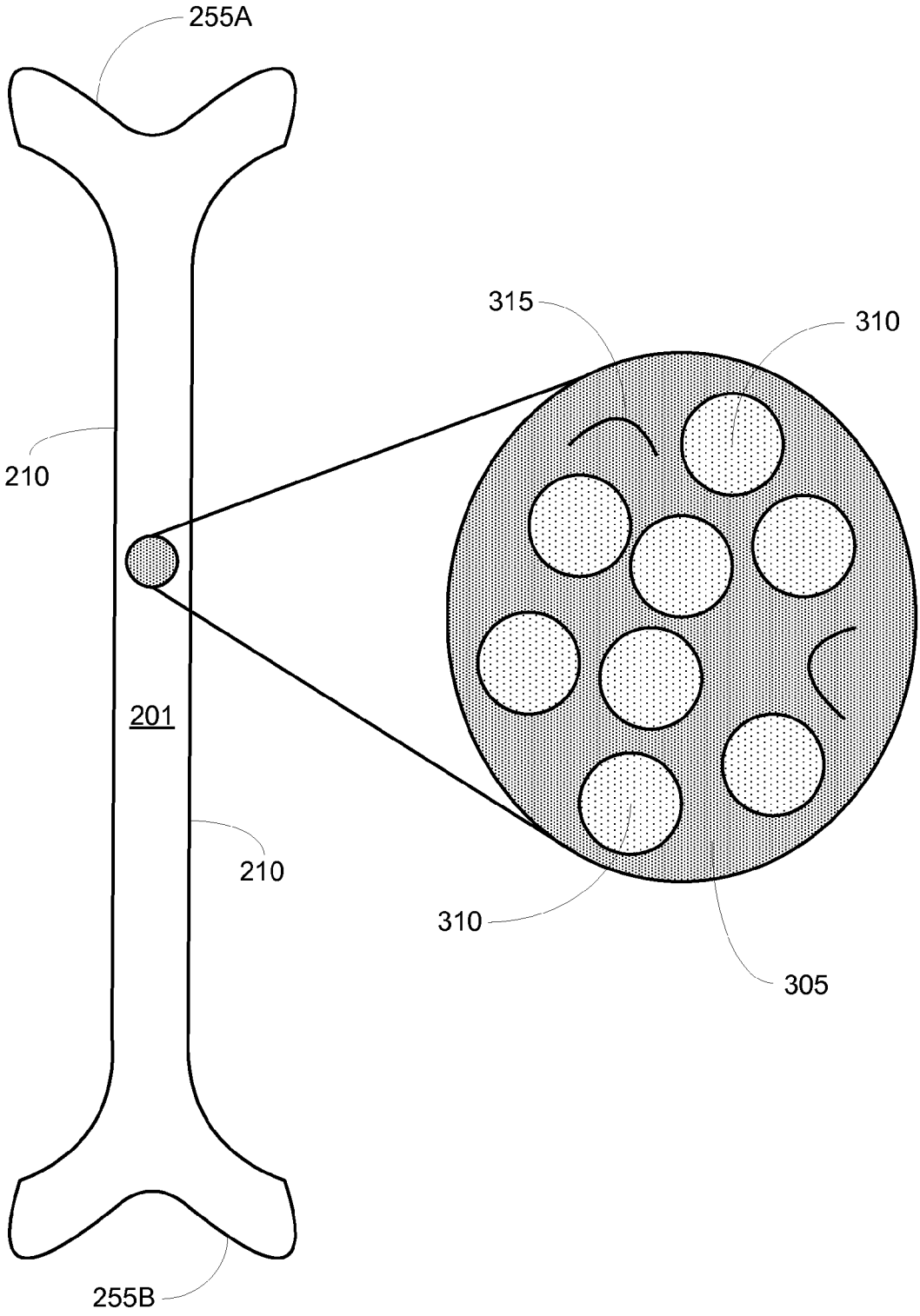
FIG. 3 is a cross-sectional view of the vane ribbon depicted in FIG. 2 illustrating an exemplary, microscopic structural arrangement of the composite material produced during the FIG. 1 process.

FIG. 3 is a cross-sectional view of the vane ribbon 200 illustrating an exemplary microscopic structural arrangement of the composite material produced and extruded during the exemplary FIG. 1 process. As can be seen in the depiction, the microscopic structural arrangement of the composite material includes a mixture of a polymer 305, such as a thermoplastic polymer, and a plurality of structural elements 310, such as hollow glass bubbles. Notably, the regrinding and blending of scrap composite material at blocks 125 and 130 of FIG. 1 envisions the destruction of a percentage of the structural elements 310 such that they become partial structural elements 315.

As one of ordinary skill in the art would understand, the composite material essentially takes the form of a "honey comb" like arrangement, providing structural rigidity via distribution load through the polymer 305 matrix and across the structural elements 310. Moreover, to the extent that partial structural elements 315 are dispersed within the polymer matrix, the partial structural elements 315 advantageously act as agents of reinforcement serving to provide increased structural rigidity to the overall composite arrow vane.

Advantageously, the composite material may allow for a decrease in overall vane thickness and/or weight without sacrificing the performance of the vane. For instance, because the stiffness of the composite material resulting from the mixture of structural elements 310 into the polymer 305 is increased over that of a homogeneous polymer, the overall thickness and/or weight of a composite arrow vane may be reduced relative to other vanes known in the art without sacrificing performance. Similarly, because the average density of the composite material resulting from the mixture of structural elements 310 into the polymer 305 is decreased relative to that of a homogeneous polymer, the performance of any given vane design may be improved as a result of reduced weight.

In an exemplary composite arrow vane, the composite material used to form the vane included about 20% by weight of microscopic hollow glass bubbles added to a virgin thermoplastic polyurethane ("TPU") polymer. The resulting density reduction relative to a homogeneous TPU polymer was on the order of 14%. The overall weight reduction represented by the exemplary composite arrow vane relative to a comparable arrow vane constructed of homogeneous TPU was on the order of 50%, resulting from the reduced average density and a reduction in vane thickness that was possible because of the increased stiffness of the composite material. The exemplary composite arrow vane outlined above, which included a 33% reduction in thickness relative to the comparable vane, was measured to have a Young's Modulus stiffness of about 21,400 PSI as compared to a Young's Modulus stiffness of about 22,700 PSI for the comparable vane made from homogeneous TPU. Moreover, a second comparable vane with the 33% reduction in thickness and made from a homogenous TPU was calculated to have a Young's Modulus stiffness of only about 6500 PSI.

Notably, the exemplary composite vane described above is meant for illustrative purposes only and does not limit the scope of a composite arrow vane. That is, a composite arrow vane is not limited to being constructed from a composite material formed from a 20% by weight addition of structural elements 310 in the form of hollow glass bubbles. It is envisioned that any formulation of a polymer with structural elements may provide for a lighter arrow vane with improved stiffness over vanes of comparable dimensions made from homogenous polymers.

Moreover, although the structural elements 310 are described in the above example as taking the form of hollow glass bubbles, a composite arrow vane is not limited to composite material formed from the combination of a polymer with a portion of per se hollow structural elements. That is, it is envisioned that some embodiments of a composite arrow vane may include a composite material formed from a polymer mixed with structural elements other than hollow structural elements. As a non-limiting example, it is envisioned that embodiments of a composite arrow vane may be constructed from a composite material formed from blending a polymer with solid glass structures, carbon structures, aramid fibers, metal fibers, etc.

It is also envisioned that embodiments of a composite arrow vane may include a composite material formed from blowing agents. In a composite material formed via blowing agents, gas is released within the compound when the compounded blowing agent particles are heated thus creating voids that operate as the structural elements within the composite compound. For instance, blowing agent particles may be compounded with a polymer at a rate of 0.2-2% by weight. In some exemplary composite arrow vanes constructed from a composite material compounded with 2% blowing agent particles, total weight reductions of 35% have been achieved, as compared to an arrow vane made from entirely homogenous polymer.

As one of ordinary skill in the art would understand, blowing or foaming agents fall into two general classes—physical and chemical. It is envisioned that a composite arrow vane embodiment may include a composite material constructed from blowing agents of either physical or chemical classification (or both). Various gasses and volatile liquids are used as physical blowing agents. Chemical foaming agents ("CFAs") can be organic or inorganic compounds that release gasses upon thermal decomposition. CFAs are typically used to obtain medium- to high-density foams, and are often used in conjunction with physical blowing agents to obtain low-density foams.

CFAs can be categorized as either endothermic or exothermic, which refers to the type of decomposition they undergo. As is understood by one of ordinary skill in the art, endothermic type CFAs absorb energy and typically release carbon dioxide and moisture upon decomposition, while the exothermic type CFAs release energy and usually generate nitrogen when decomposed. The overall gas yield and pressure of gas released by exothermic foaming agents is often higher than that of endothermics.

Blends of these two classes are sometimes utilized for certain applications. Such is the case for profile extrusion, where the high gas pressure and volume from the exothermic portion help fill the profile while the controlled gas yield and cooling from endothermic decomposition reduce profile warpage. Endothermic CFAs are generally known to decompose in the range of 130 to 230 C (266-446 F), while some of the more common exothermic foaming agents decompose around 200 C (392 F). However, the decomposition range of most exothermic CFAs can be reduced by addition of certain compounds, as is understood in the art.

Figure 4A:
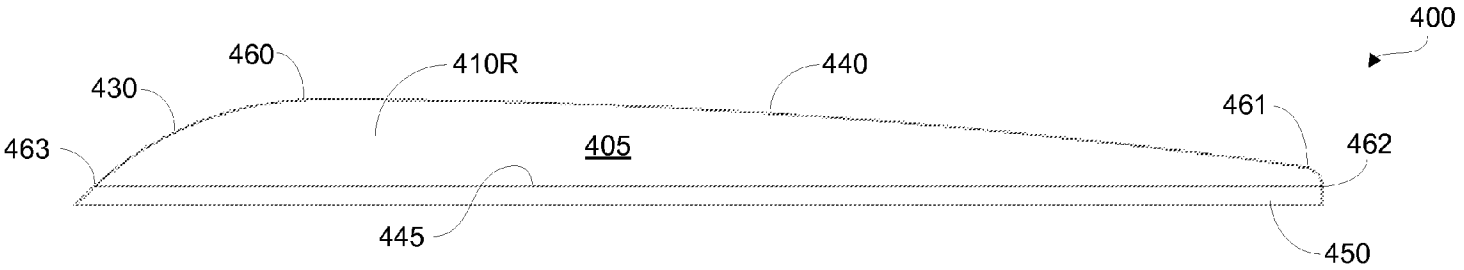
FIG. 4A is a side-profile diagram of an exemplary embodiment of a composite arrow vane.

FIG. 4A is a side-profile diagram of an exemplary embodiment of a composite arrow vane. The vane member 400 includes two main components, the vane fin 405 and the vane base 450. The vane fin 405 is a flat piece of composite material, such as a material as described above or equivalent, having a right-side planar surface 410R and a left-side planar surface 410L (not shown in this FIG. 4A). The shape of the vane fin 405 is defined by a back-edge or rear-edge 430, a front-edge 440 and a base edge 445. Traversing the contour of the vane fin 405, the back-edge 430 is an arc that extends upward from point 463 where it meets the base edge 445, to a point 460 (the top of the vane 400) where it meets the rearward end of the front-edge 440. The front-edge 440 then extends downward in a slightly curved fashion towards point 461 where it abruptly curves toward point 462 and terminates at the base edge 445. The based edge 445 extends from point 462 in a linear fashion to point 463.

Notably, although rear-edge 430 and front-edge 440 are described and depicted in the exemplary FIG. 4 embodiment to be comprised of concave curves, one of ordinary skill in the art will recognize that any or all of the edges of vane fin 405 may be altered to a substantially linear form, or convex curve, without necessarily departing from the scope of the disclosure. Moreover, one of ordinary skill in the art will recognize that not all embodiments will necessarily include a front-edge 440 that transitions from a first curve between points 460 and 461 to a second, more abrupt, curve between points 461 and 462. That is, it is envisioned that the front-edge 440 of some embodiments may continue from point 460 to point 462 on a single curve defined by a certain radius.

Figure 4B:
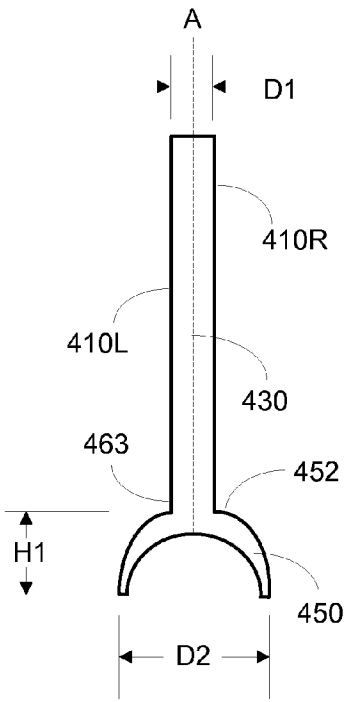
FIGS. 4B-4C are rear-profile and front-profile diagrams, respectively, of the embodiment illustrated in FIG. 4A.
Figure 4C:
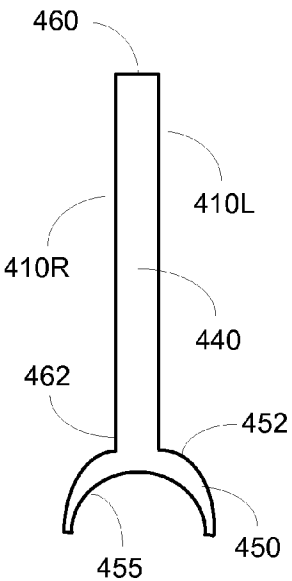

FIGS. 4B-4C are rear-profile and front-profile diagrams, respectively, of the exemplary embodiment illustrated in FIG. 4A. As shown in FIGS. 4B-4C, the right-side planar surface 410R and the left-side planar surface 410L are spaced apart by a width D1 to form the back-edge 430, front-edge 440 and base-edge 445. Notably, although the width D1 of the illustrative embodiment is depicted as remaining constant throughout the height of vane fin 405 from base edge 445 to top point 460, it is envisioned that some embodiments may have a width measurement proximate to base edge 445 that is increased over a width measurement taken proximate to top point 460. In an exemplary embodiment, the width D1 is approximately 0.028 inches, however, it will be appreciated that other widths for D1 are envisioned for other embodiments and, as such, a particular value or range of values for D1 (although perhaps novel in and of itself) will not limit the scope of the invention. In fact, as described above, it is an advantage of composite arrow vanes that the increased stiffness allows for width D1 to be reduced relative to other vanes that include homogenous polymers without significantly sacrificing performance.

The base 450 is substantially perpendicular to the vane fin 405 and has a top surface 452 and a bottom surface 455. The top surface 452 of the base 450 is attached, adhered, adjoined, integral with or otherwise meets or corresponds with the bottom-edge 445 of the vane fin 405. The bottom surface of the base 450 is attachable to the surface of an arrow shaft or, in some embodiments, may be attachable or integral to an arrow wrap component configured to securely wrap around an arrow shaft.

In some embodiments, the base 450 may be substantially box-shaped with the top surface and the bottom surface being two substantially parallel and flat surfaces, joined together by four edges that are substantially perpendicular to the top surface and the bottom surface to form the box. In other embodiments, the bottom surface may be arched to correspond with the cylindrical surface of the arrow shaft to which it will be attached. In yet other embodiments, such as the exemplary embodiment depicted in FIGS. 4B-4C, the entire base 450 may be curved in accordance with the arrow shaft. Although the present invention is not limited to any particular structure for the base 450, it will be appreciated that the embodiments presented herein, such as but not limited to the embodiment described below relative to FIG. 5, may in and of themselves be considered novel aspects or features of various novel embodiments. Although the base 450 is described as mounting to the surface of an object, it will be appreciated that the base could also be embedded in a slot of the surface or a recess, welded to the shaft, molded into the shaft or otherwise integral with the shaft.

The base 450, in an exemplary embodiment of the invention, is larger than the width of the vane fin 405. In some embodiments, the width D2 of the base 450 is approximately 0.140 inches, although other widths are envisioned for accommodation of various shaft sizes used in the art and, as such, the particular width D2 will not limit the scope of the disclosure. The illustrated base 450 is positioned relative to an axis extending through the vane fin 405 from the base-edge 445 up through the top of the vane 460 as illustrated by the dotted line A. In an exemplary embodiment, the height H1 of the base 450 from the point 463 to the bottom is approximately 0.051 inches.

Figure 5A:
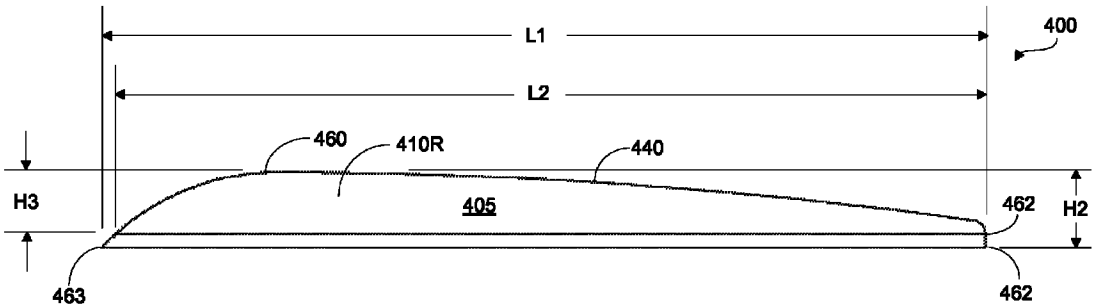
FIGS. 5A-5B are side-profile diagrams of the FIG. 4 composite arrow vane embodiment and identifying particular dimensions and dimension ranges.
Figure 5B:
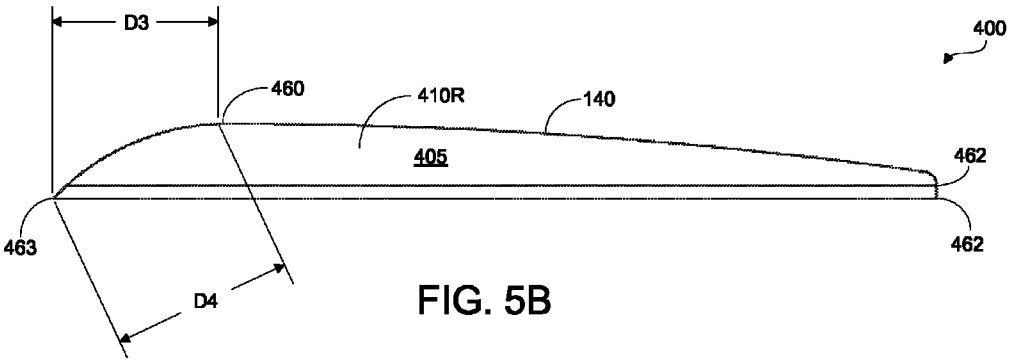

FIGS. 5A-5B are side-profile diagrams of an exemplary embodiment of a composite arrow vane and identifying exemplary dimensions and dimension ranges. The length L1 of the vane 400 is the distance from point 262 to point 263. The length L2 of the vane fin 405 is the distance from point 462 to point 463 and basically is the length of the bottom-edge 445. It will be appreciated that although the length L1 of the base 450 is illustrated and described as being longer than the length L2 of the vane fin 405, it is envisioned that in some embodiments the base 450 may be shorter than the bottom-edge 445 (L1<L2) or the base 450 may be the same length as the base-edge 445 (L1=L2) and as such, the present invention is not limited to any particular relationship, although the various relationships may be considered as novel aspects of the present invention. Thus, in some embodiments, the length L1 is the length of the vane 400, whereas in other embodiments, the length L2 is the length of the vane 400, and yet in other embodiments, the lengths L1 and L2 are equal and represent the length of the vane 400.

In the illustrated embodiment, the bottom-edge 445, and hence, the length of the vane fin 405, is slightly shorter than the length of the base 450, or in this case the length of the vane 400. In an exemplary embodiment, the value of L1 is 3.997 inches±0.005 inches, although it is envisioned that the length L1 may be any length without departing from the scope of the disclosure. For instance, it is envisioned that some embodiments may have an L1 of 2.997 inches±0.005 inches. It is further envisioned that other embodiments may have an L1 of 1.9997 inches±0.005 inches.

The height of the vane 400 from the bottom surface of the base 450 to the top of the vane 460 is H2 and the height of the vane fin 405 from the bottom-edge 445 to the top of the vane 460 is H3. In an exemplary embodiment, H2 is 0.327 inches±0.005 inches and H3 is 0.276±0.005 inches. Thus, in the illustrated embodiment which depicts an L1 of 3.997 inches±0.005 inches, the ratio of the length of the vane to the height of the vane is approximately 12:1. Notably, one of ordinary skill in the art will recognize that the ratio of the length of the vane to the height of the vane will change in embodiments having different lengths of L1. For example, in an embodiment having an L1 of 2.997 inches±0.005 inches, the ratio of the length of the vane to the height of the vane is approximately 9:1.

The front-edge 440 is an arc extending from point 461 to point 460 and opening towards the bottom-edge 445 of the vane fin 405. In an exemplary embodiment, the radius of the front-edge arc is approximately 19.807±0.005 radians. Notably, it is envisioned that the radius of the arc of front-edge 440 may be more or less than 19.807±0.005 radians, if arced at all, and, as such, the specific radius associated with front-edge 440 is not a limiting factor for the scope of the disclosure.

Similarly, the back-edge 430 is an arc extending from point 463 to point 460 opening towards the bottom-edge 445 of the vane fin 405. In an exemplary embodiment, the radius of the back-edge arc is approximately 1.087±0.005 radians. Notably, it is envisioned that the radius of the arc of back-edge 430 may be more or less than 1.087±0.005 radians, if arced at all, and, as such, the specific radius associated with back-edge 430 is not a limiting factor for the scope of the disclosure.

In the exemplary embodiment, the horizontal distance D3 from top point 460 to point 463 is approximately 0.747±0.005 inches. In addition, the geometric chord D4 from point 463 to top point 460 is approximately 0.813±0.005 inches. Notably, one of ordinary skill in the art will recognize that the lengths of D3 and D4 will vary across embodiments of the invention.

The particular embodiments of a composite arrow vane described in detail relative to FIGS. 4 and 5 have been offered for illustrative and enabling purposes only and do not limit the dimensional aspects within which an embodiment of a composite arrow vane must fall. A composite arrow vane may be any vane that includes a composite of polymer and structural elements and is suitable for use on a projectile, such as an arrow or crossbow bolt.

Figure 6B:
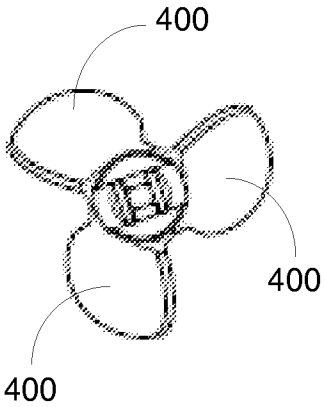
FIG. 6B is a rear view of the arrow shaft and plurality of helically mounted composite arrow vanes depicted in FIG. 6A.
Figure 6A:
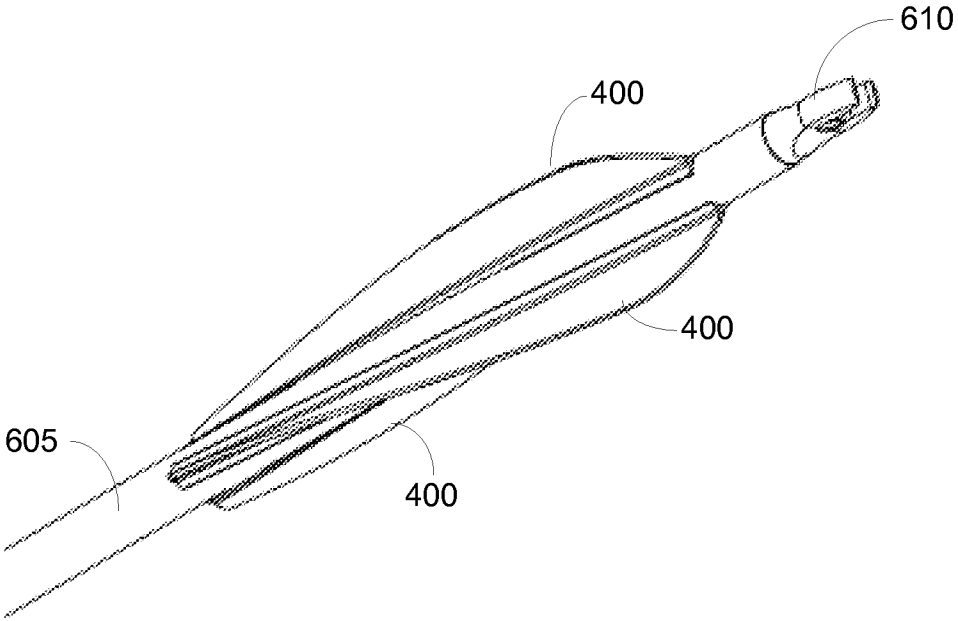
FIG. 6A is a perspective drawing of a plurality of composite arrow vanes according to an exemplary embodiment, shown mounted to an arrow shaft along complimentary helical paths.

FIG. 6A is a perspective drawing of a plurality of composite arrow vanes according to an exemplary embodiment of the present invention, shown mounted to an arrow shaft 605 along complimentary helical paths. Notably, as one of ordinary skill in the art would recognize from the depiction of a nock 610, the vanes 400 are mounted to the aft end of the arrow shaft 605. The plurality of vanes 400 are represented in a numerical combination of three, although a greater number of vanes may be used and even lesser vanes can be used depending on the embodiment or use of the vane.

FIG. 6B is a rear view of the arrow shaft 605 and plurality of helically mounted vanes 400 depicted in FIG. 4A.

It should be appreciated that the various embodiments of the described composite arrow vane can be attached to a variety of objects or projectiles and although the embodiments have primarily been described as being affixed to an arrow, they may also be affixed to other projectiles, such as darts, lawn darts, spears, javelins, model airplanes, toy rockets, crossbow bolts or the like. Further, embodiments of the invention may be constructed of any composite material which provides a substantially rigid contour during arrow flight. Plastics or other synthetic materials mixed with structural elements are among included possible materials. The composite material may be resiliently bendable, such that, if outside force causes it to alter shape, it will return to its original contour. In other embodiments, the composite material may be substantially rigid.

One of ordinary skill in the art will recognize that embodiments of the present invention, due to the high ratio of length to height, may provide less probability of interference with bow components as an arrow is launched. As such, it is an advantage of the present invention that stiffer composite materials of construction may be selected without concern for unforgiving interference with bow components. In turn, stiffer and stronger material selection may provide for more effective rotational forces on the arrow (i.e., arrow spin). Similarly, the suitability of some embodiments for application along a helical path of the arrow shaft surface provides for increased introduction of lift and side forces without a vane height that can interfere with bow components.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A composite arrow vane for mounting to a projectile, the composite arrow vane comprising:

a base for mounting on the surface of the projectile; and a vane fin including a contour defined by a bottom-edge, a rear-edge and a front-edge, and having a length L and a Height H with a ratio of L to H being approximately 12 to 1, wherein:

the bottom-edge has a front point and a back point and is substantially linear between these points and is adjoined to the base;

the rear-edge degrades along a first curve with an associated first radius from an upper point to a lower point, the lower point corresponds to the back point of the bottom-edge; and the front-edge has an upper point and a lower point, the upper point of the front-edge corresponds to the upper point of the back-edge, and degrades from the upper point of the front-edge toward the lower point of the front edge which corresponds with the front point of the bottom-edge;

wherein the front-edge degrades towards the front point of the bottom-edge along a second curve with an associated second radius to a transition point and then arcs concave to the bottom-edge downwardly from the transition point along a third curve having an associated third radius to the front point of the bottom-edge;

wherein the third radius of the front-edge is less than the second radius of the front-edge;

wherein the base and vane fin comprise a composite material of a polymer matrix and a plurality of structural elements.

2. The composite arrow vane of claim 1, wherein the height of the vane fin H is 0.276 inches±0.005 inches.

3. The composite arrow vane of claim 1, wherein the length of the vane L is 3.997 inches±0.005 inches.

* * * * *